United States Patent [19]

Sly

[11] 4,027,584

[45] June 7, 1977

[54] WATER ACTUATED GARBAGE COMPACTOR

[76] Inventor: Howard M. Sly, 685 Gardiners Road, Kingston, Ontario, Canada

[22] Filed: June 12, 1975

[21] Appl. No.: 586,343

[30] Foreign Application Priority Data

July 5, 1974 Canada ..... 204235

[52] U.S. Cl. ..... 100/218; 100/49; 100/99; 100/250; 100/269 R; 100/295

[51] Int. Cl.[2] ..... B30B 15/32; B30B 1/32

[58] Field of Search ..... 100/245, 269 R, 249, 100/250, 49, 99, 218, 295

[56] References Cited

UNITED STATES PATENTS

| | | | |
|---|---|---|---|
| 1,939,556 | 12/1933 | Kammer | 100/269 R |
| 2,085,695 | 6/1937 | Dinzl | 100/269 R |
| 2,916,985 | 12/1959 | Beach | 100/269 R |
| 2,916,987 | 12/1959 | Hanni | 100/269 R |
| 3,024,720 | 3/1962 | Welsh | 100/269 R |
| 3,654,855 | 4/1972 | Longo | 100/269 R |
| 3,802,335 | 4/1974 | Longo | 100/269 R |

FOREIGN PATENTS OR APPLICATIONS

| | | | |
|---|---|---|---|
| 1,216,954 | 12/1959 | France | 100/269 R |

*Primary Examiner*—Billy J. Wilhite
*Attorney, Agent, or Firm*—Cushman, Darby & Cushman

[57] ABSTRACT

A compacting apparatus is described which is operated by pressures derived from a municipal or household supply of water under pressure. The apparatus includes a compression chamber having a feed opening therein for introducing material to be compacted in said chamber. The compression chamber is generally elongated and in one end portion thereof a closeable opening is provided for removal of a slug of compacted material. A moveable cylinder is closely received in the compression chamber, and has one end thereof which operates as a ram for compacting the material therein. The cylinder houses a stationary piston which includes a plate in sealed engagement peripherally of the cylinder to divide that cylinder into two sections. A fluid circuit is connectable in flow communication with each of the sections of the cylinder, and with an external supply of water under pressure. Valve means provided in that fluid circuit are operable selectively to introduce water under pressure into one of the sections for advancing the moveable cylinder, and into the other section for retracting that cylinder. In the preferred embodiment, that section of the cylinder which forms the ram has an area substantially equal to the cross-sectional area interiorly of the compression chamber. In another preferred embodiment, the compression chamber is an elongated cylinder having a closeable opening in one end thereof, and a closure member is provided, pivotally supported from the compression chamber for closing the opening.

1 Claim, 7 Drawing Figures

WATER ACTUATED GARBAGE COMPACTOR

This invention relates to a compacting apparatus in which a piston and cylinder combination is provided, with the cylinder being moveable to effect compacting of material. More specifically, the compacting apparatus herein is operable under the pressure of water derived from a municipal or household water supply for both advancing and retracting motions.

BACKGROUND OF THE INVENTION

Various devices have been proposed in recent years to cope with the increasingly difficult problem of handling garbage and refuse material generated by residents living in an urban area. It is convenient here for the reader to refer, for example, to U.S. Pat. Nos. 3,384,007 which issued May 21, 1968 to Boje et al; U.S. Pat. No. 3,669,009 which issued June 13, 1972 to Pratt et al; or U.S. Pat. No. 3,685,438 which issued Aug. 22, 1972 to W. E. Ziegler. Two additional patents which show similar structures are Canadian Pat. No. 905,210 and 914,483 of Longo which issued respectively, on July 18 and Nov. 14, of 1972. In the Canadian Pat. No. 914,483, a compaction device is shown for compressing household refuse. Pressure used to drive a compression ram is derived from a municipal water supply. This water is introduced into an extensible bellows which cases a ram to advance and compact refuse ahead of it. The structure of this patent does not use that water pressure for retracting the ram elements, and instead, relies upon forces derived from a high tension helical spring. The other Canadian patent mentioned above, namely, 905,210 also shows a waste compacting device. This device includes a horizontally extending compression chamber which includes an upwardly facing feed opening for receiving waste material. A ram which comprises a transverse plate and a horizontally oriented gate-defining plate are moveable under the effect of a double acting hydraulic cylinder. A four-way valve is used to direct the hydraulic fluid to the appropriate side of the hydraulic cylinder, thereby to cause either retraction or advancement of the ram.

U.S. Pat. No. 3,669,009 of Pratt et al. discloses a compacting device for household trash and garbage. This trash compactor features a double-acting piston which is advanced and retracted under the effects of hydraulic pressure derived from a home water system. It will be seen, however, that the movable piston in this device carries an elongated plate which acts as a ram to compress the refuse material ahead of it. Substantial bending moments can be generated by the overhang of the opposed end portions of the ram plate relative to the connection of that plate to the movable piston. Thus, the uniform distribution of cans, bottles or other solid items in the compression chamber is important for optimum efficiency in operation.

Certain of the other prior art patents referred to require a piston and cylinder combination which uses conventional hydraulic fluids and reservoirs, and clearly necessitates the extra cost in providing equipment such as a driving motor and pump. Further yet, the pressure capability of such pumps must be substantial, and this incurs extra expense.

SUMMARY OF THE INVENTION

The present invention provides a compacting apparatus whose operation is simple and reliable. Perhaps even more importantly for residential use, the compacting apparatus below involves few parts with the result that the purchase and operating costs can be kept low. Further yet, the simplicity in structure and the use of a few moving parts will normally improve the reliability of operation of the device as well as eliminate many component parts required previously.

Accordingly, there is embodied in one aspect of this invention a compacting apparatus which comprises a compression chamber having means for introducing material to be compacted in said chamber, and a closeable opening for removal of a slug of compacted material; a moveable cylinder closely receivable in the compression chamber and having one end thereof operable as a ram to compact the material in said chamber. The cylinder houses a stationary piston having means in sealing engagement peripherally of the cylinder interior to divide said cylinder into two sections. A fluid circuit is also provided in flow communication with each of the sections of the cylinder, for connection to a supply of water under pressure. Valve means are provided in the circuit, and operate selectively to introduce water under pressure into one of the sections for advancing the cylinder, and into the other of said sections for retracting the cylinder.

In one preferred form encompassed by this invention, the compacting apparatus herein has one section of the moveable cylinder of an area substantially equal to the cross-sectional area interiorly of the compression chamber. This enables substantial compression forces in the order of at least five hundred pounds or more, to be generated from the municipal or household water supply which frequently may provide pressures as low as twenty to thirty pounds per square inch. Further yet, the pressure of compaction is applied uniformly by the entire frontal area of the moveable cylinder, thereby inhibiting significantly any tendency to generate uneven loading of the compression ram during its advancing motion.

In yet another aspect of this invention, the compacting apparatus herein is provided with a pair of fluid conduits extending generally longitudinally and interiorly of the compression cylinder, each one of these fluid conduits being connectable to one of the sections in that cylinder, thereby to introduce water under pressure selectively into a first section and discharge water from the second of said sections, and vice versa, thus using the pressure derived from a household or municipal water supply for both advancement and retraction of the moveable cylinder.

Various features and advantages of the present invention will become apparent from the detailed description below. That description is now to be read in conjunction with the accompanying drawings. These drawings illustrate by way of example only one preferred form of compacting apparatus embodied by this invention.

DESCRIPTION OF THE PREFERRED EMBODIMENTS

Figure 1:
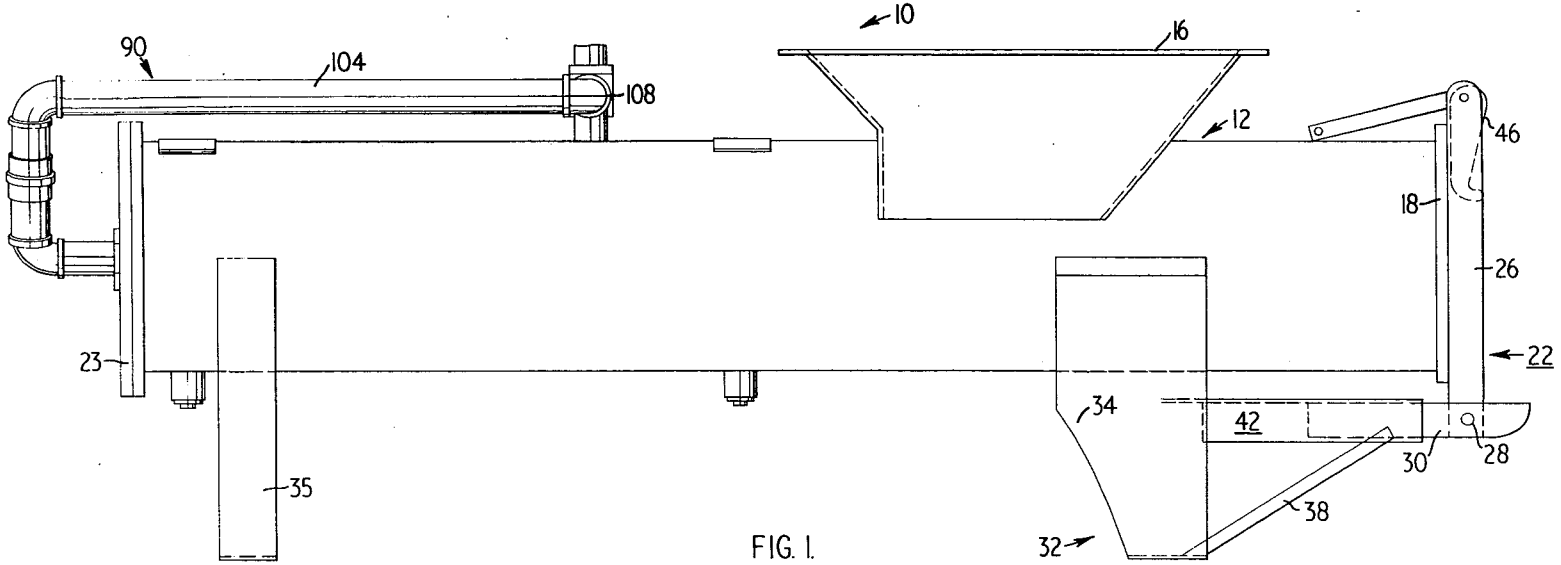
FIG. 1 is a side elevation view showing one preferred form of garbage compacting apparatus envisaged herein.
Figure 2:
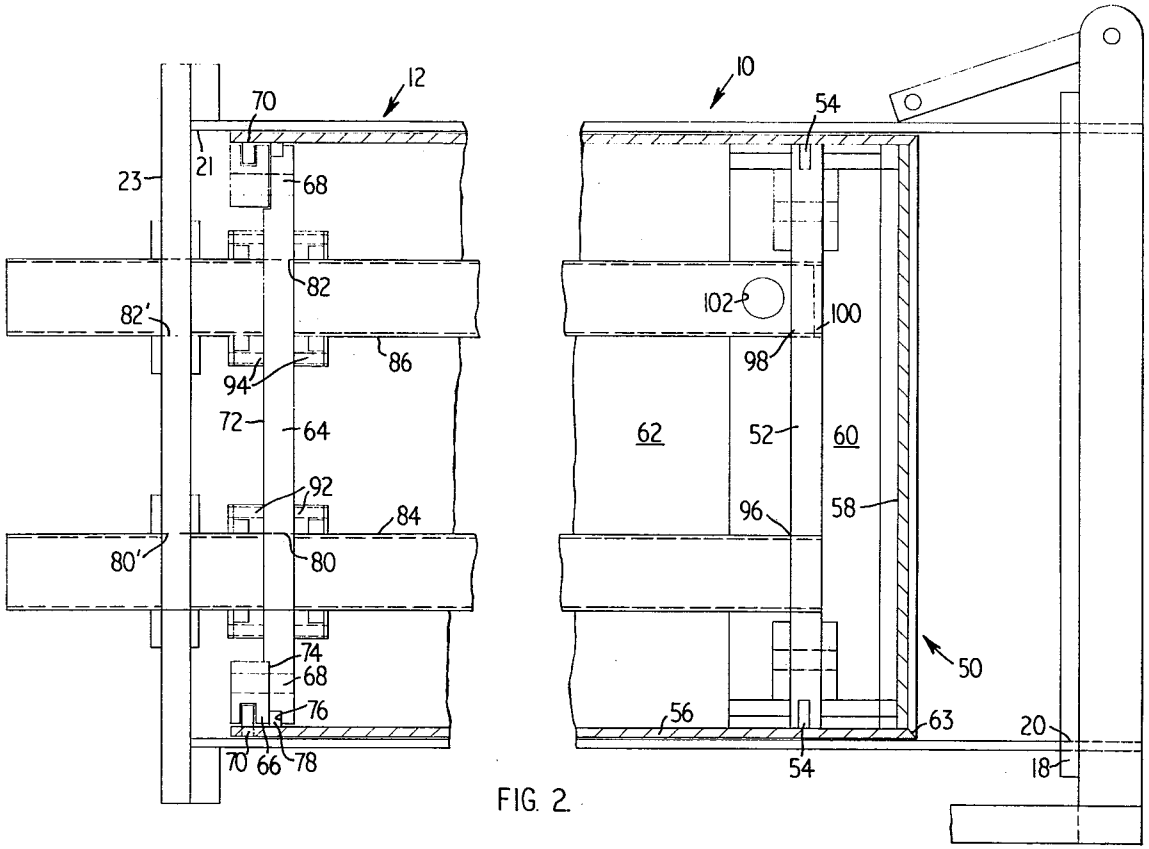
FIG. 2 is a top plan view, taken in cross-section generally centrally of the apparatus of FIG. 1.
Figure 3:
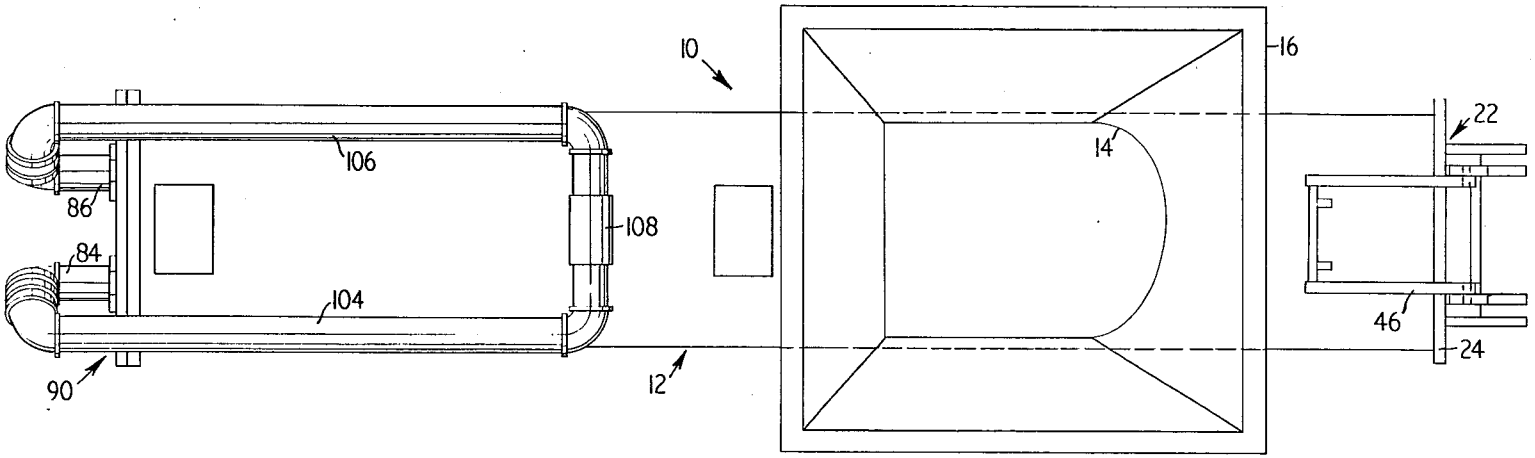
FIG. 3 is a top plan view of the apparatus of FIGS. 1 and 2.
Figure 4:
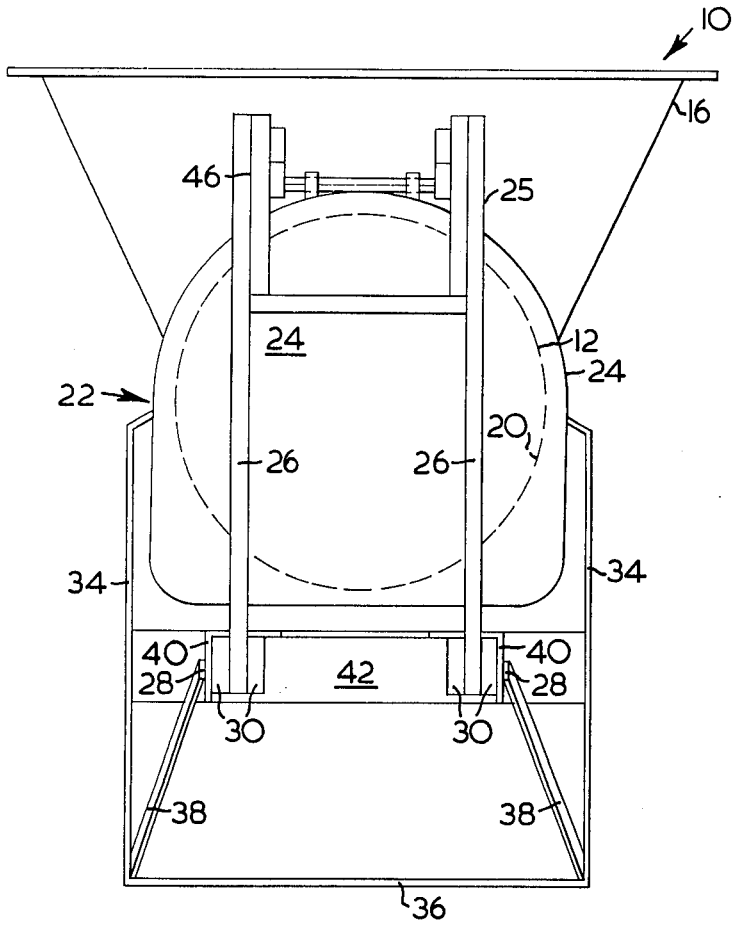
FIG. 4 and FIG. 5 are, respectively, front and rear elevation views of the apparatus of FIGS. 1–3.

A preferred form of the compacting apparatus envisaged by this invention is shown overall at 10 in FIGS. 1 – 5 herein. Thus, the compacting device 10 has a tubular compression chamber 12 that is for convenience only of a circular cross-sectional form. Other shapes can also be used if desired. The compression chamber 12 is formed on one side thereof with an opening 14 (FIG. 3) associated with an inlet feed hopper 16 which allows waste material to be introduced into the compression chamber. At one end of the compression chamber 12 there is provided a radially outwardly directed flange 18. This flange 18 serves to define an opening 20 which is closeable by a door assembly 22. The opposite end of chamber 12 has an opening 21 which is closed by a cover plate 23. With reference to FIGS. 1 and 4, the door assembly 22 comprises a door panel or closure plate 24. A supporting frame 25 includes a spaced apart pair of brace members 26, with each of these brace members being apertured at one end thereof to receive pin means 28. The pin means 28 enable the door assembly 22 to be pivotally supported from a pair of side rails 30 that are welded or otherwise fixedly secured to a base frame shown overall at 32. More specifically, the base frame 32 includes a pair of upstanding supports 34 which are welded at one end thereof to the compression chamber 12, and at the other end thereof to a cross member 36. A forward base frame 35 is of a generally similar construction, and coacts with frame 32 to support the apparatus 10. A pair of angular braces 38 are connected at one end thereof to a respective one of the members 34, and at the other end thereof to an associated cantilever in the form of an angle iron 40. Each of the angle irons 40 is welded at the other end thereof to a transverse supporting element in the form of another angle iron 42, and have the rails 30 welded thereto as an extension tension of the same. A locking mechanism 46 is provided on the door assembly 22 at the edge opposite to the pivotal mounting pins 28, and enable the door assembly 22 to be locked shut, and made capable of resisting the pressures developed within the compression chamber 12 as compaction occurs. It wll be apparent that the particular structure shown in FIGS. 1 and 4 is only one convenient form which the locking mechanism 46 may take. Numerous other mechanical locking mechanisms will be apparent to those knowledgeable in this art. For structural simplicity, it is preferrable that the locking mechanism 46 be mechanical and manually operable.

With particular reference to FIG. 2, a piston and cylinder combination 50 is provided inside of the compression chamber 12. The combination 50 includes a piston in the form of a flat plate or disc 52. This flat plate 52 is provided peripherally thereof with sealing means 54 which are adapted to be in sealed engagement with the interior surface of a tubular cylinder 56. Contrary to arrangements shown in the prior art mentioned above, the cylinder 56 is moveable within the compression chamber 12. Indeed, one end 58 of the cylinder 56 forms a compression ram which causes compacting of refuse and waste material introduced into the compacting apparatus 10. The plate 52 is fixed in position, and serves to divide the cylinder 56 into two sections 60 and 62. Thus, the fixed plate 52 and the end plate 58 along with the side walls of the cylinder 56 define the limits of the section 60. In a similar manner, the other face of the plate 52 along with the side wall of the cylinder 56 and a second end plate 64 define the limits of the section 62. The volume of the sections 60 and 62 is variable inversely, i.e, as section 60 increases in volume, section 62 decreases; and vice versa. These changes occur as compaction and retraction take place.

The moveable cylinder 56 is complementary in shape to the compression chamber 12, and has a frontal area which is substantially equal to the cross-sectional area of the interior of the compression chamber 12. As will be evident from FIG. 2, a slight amount of radial clearance is provided between the exterior of the cylinder 56 and the interior of the compression chamber 12, thus accomodating reciprocal sliding movement of the cylinder. For convenience, the refuse-engaging face of the cylinder 56 and plate 58 is provided with a peripherally extending beveled flange 63. This flange 63 is an extension of the side wall of the cylinder 56 in an axial direction, and functions to scrape away from the interior wall of the compression chamber 12 any of the waste material which might have a tendency to stick.

At the other end of the cylinder 56, the second end plate 64 is connected to the side wall 56 by means of a coupling ring assembly 66. The coupling ring assembly 66 comprises a pair of annular discs which are adapted to be connected together, and to the plate 64 by threaded fasteners 68, preferrably in the form of bolts or screws. The connecting ring assembly 66 is itself connected to the cylinder 56 by a series of set screws 70 which are spaced apart peripherally of the ring assembly and cylinder 56. The end plate 64 has an outwardly directed face 72 which is provided with a shallow shoulder 74 and a deeper shoulder 76 adjacent the periphery thereof. The shoulder 74 is adapted to provide a seat for the ring assembly 66. Sealing means 78 are adapted to be seated in the shoulder 76, and are clamped in place by attachment of the ring assembly 66 by fasteners 68.

The cover and end plates 23 and 64 are also provided with a pair of openings 80, 80′ and 82, 82′ through which a pair of conduits 84 and 86 extend. These conduits 84and 86extend. 84 and 86 are normally in the form of tubular metal pipes which form part of a fluid circuit shown overall at 90 in FIGS. 1 and 3. The junction of the conduits 84 and 86 with openings 80 and 82 is made leak-proof by sealing assemblies 92 and 94. The end of each of the conduits 84 and 86 is set into, and welded to the piston plate 52, as shown at 96 and 98 respectively. The conduit 84 extends completely through the plate 52, to be in fluid communication with the section 60 of the cylinder 56. The corresponding end of the conduit 86 is capped as shown at 100; however a port 102 is provided in that conduit adjacent the plate 52. This port 102 thereby places the conduit 86 in fluid communication with the other section 62 of the cylinder 56.

Figure 5:
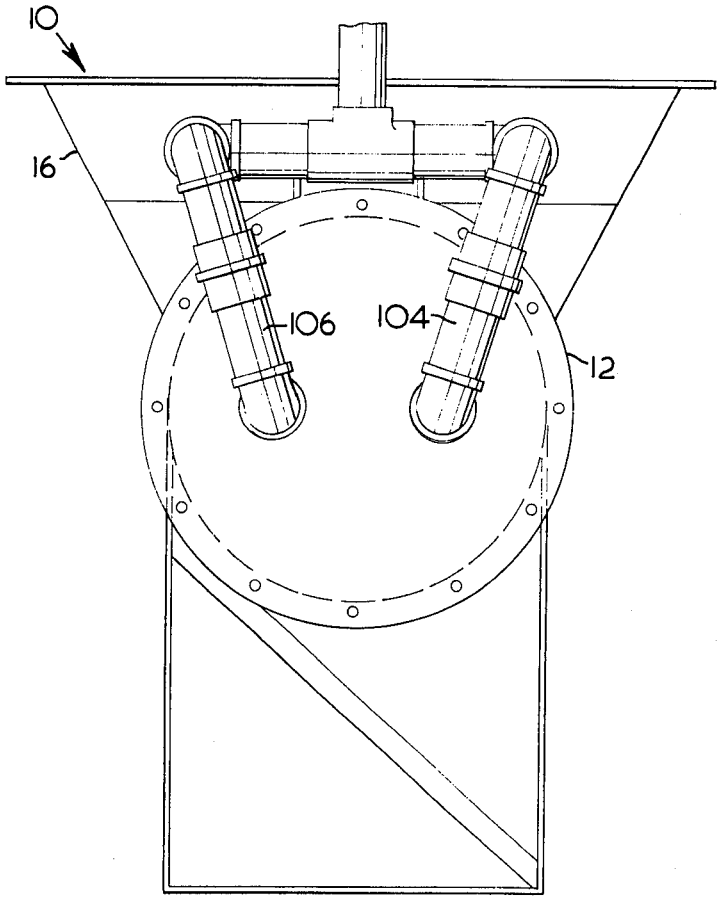

Turning to FIGS. 1, 3 and 5, it is seen that the conduits 84 and 86 are connected to additional conduits 104 and 106. These additional conduits 104 and 106 are each connected to a three-way motorized valve 108, through which the fluid circuit 90 is connectable to a municipal or household supply of water under pressure.

In operation, waste material and refuse is introduced through the inlet feed hopper 16 into the compression chamber 12. It is preferable that a photoelectric cell, or other similar indicating means is employed in the feed hopper 16 to indicate when the compression chamber 12 is sufficiently full of waste material to effect compaction thereof. When a "full" condition has been sensed, a conventional control circuit such as that shown in FIG. 6, cuases the three-way motorized valve 108 to be repositioned for compaction. Valve 108 is moved to any one of three positions by way of manually operated three-way switch 108a located in any convenient position. In that condition, the valve 108 allows water under pressure from the municipal or household supply to be conducted via the conduits 104 and 84 into the section 60 of the cylinder 56. At the same time, the condition of the valve 108 is such that the section 62 of the cylinder 56 can be depressurized, for example, by a discharge flow of water through the port 102, and conduits 86 and 106. Since water is used as the hydraulic fluid which causes compaction, the discharge flow from the section 62 (or section 60 on retraction) can simply be conducted to a sewer drain. Alternatively, the discharge flow from either section 60 or 62 could be conducted to a fluid reservoir, from which water was taken off for use elsewhere.

The water from a municipal or household water supply frequently is pressurized to an amount in the range from about 20 to 60 psi. When that pressure is applied over the plate 58 of the forward cylinder head, such pressure is applied over a substantial cross-sectional area. The result is that a very substantial compressive force is developed and applied against the waste material and refuse in the compression chamber 12. The diameter of the compaction chamber can vary from one installation to another, this being dependent in part on the volume rate of waste material to be compacted as well as the pressure force to be developed. It will, of course, be evident that since the piston plate 52 is fixed to the conduits 84 and 86, the application of pressure to the plate 58 of the forward cylinder head will cause the cylinder 56 to advance on a compression stroke.

Figure 6:
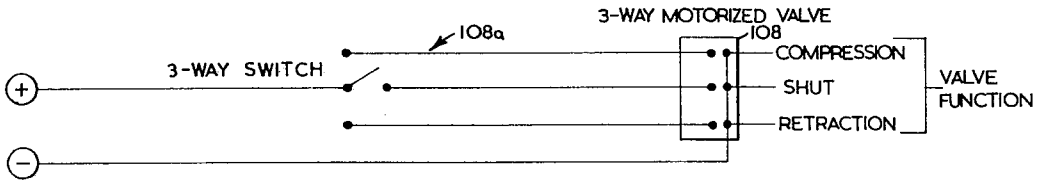
FIG. 6 is a circuit diagram showing one typical control circuit for operating the apparatus of FIGS. 1–5.

The electrical control circuit of FIG. 6 is preferably actuated by the operator to maintain the three-way valve 108 in a condition for compaction for a predetermined time interval. After a time lapse of say from about 0.25 to 5.0 minutes, the control circuit is actuated to cause the valve 108 to be repositioned for a retraction stroke of the cylinder 56. In that condition of the valve 108, water from the household or municipal supply is introduced under pressure through the conduits 106 and 86 and ports 102 into the section 62. Simultaneously therewith, the pressure is released on the fluid contained in the forward section 60 of the cylinder 56. The fluid under pressure in the section 62 exerts an axially directed force over the surface area of the plate 64 which makes up the rear cylinder head. Since pressure is no longer being developed in the forward section 60, the rearwardly directed pressure force applied over the rear cylinder head 64 causes the cylinder 56 to be retracted to the position shown in FIG. 2. It will be convenient to provide in the control circuit of FIG. 6 a limit switch (not shown) wich senses the amount of rearward travel possible for the cylinder 56, before the three-way valve 108 is to be activated, either to a by pass condition or to an advance condition for compaction of further waste material and refuse introduced into the compression chamber 12. It will be evident from the drawings that the length of the cylinder 56 is sufficient to allow forward motion on a compacting stroke of the cylinder to a position generally adjacent the discharge opening 20 while closing off the inlet feed opening 14 (of FIG. 3) by the side wall of that cylinder. When the forward portion of the compression chamber 12 contains a slug of compacted material of a predetermined size, this condition conveniently is shown by an indicator light which will be illuminated to signal the need to remove that plug of compacted material. Once that has been done, the control circuit of the compacting apparatus 10 can again be activated so that introduction of waste material into the compression chamber 12 sufficient to indicate a full condition will cause a compaction stroke of the moveable cylinder 56.

Figure 7:
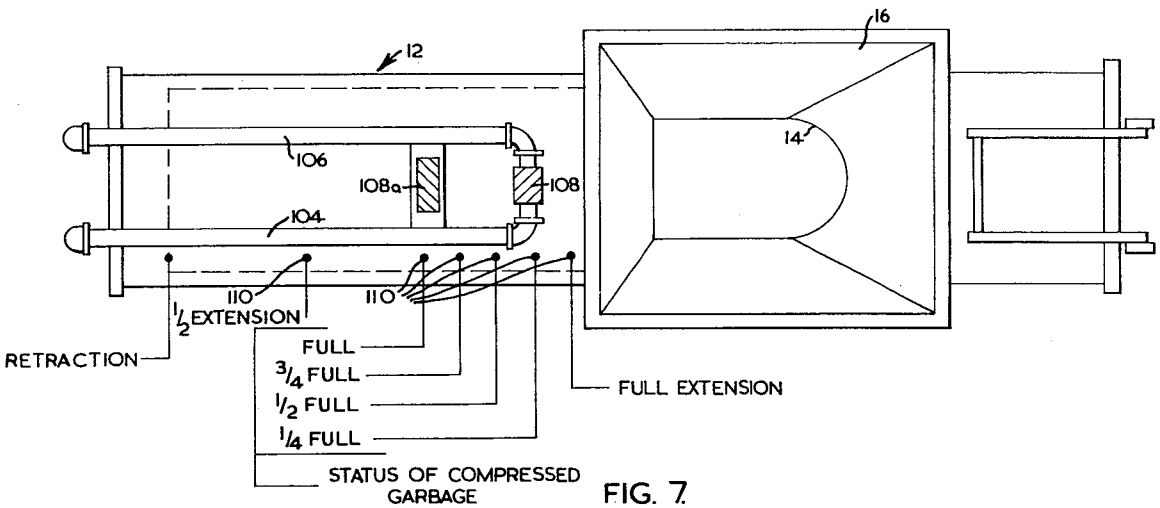

FIG. 7 illustrates an innovation for assisting the operator in determining the size of garbage slug which has been produced at the end of any stroke. This innovation comprises a series of small portholes 110 in the exterior casing of the apparatus through which the operator can view the position of the piston relative to the cylinder. The relative positions of the portholes 110 can be such as to show both the full extension and full retraction positon, the half extended positon and full, ¾, ½ and ** full conditions of the compressed garbage slug.

The foregoing disclosure has described one preferred form of compacting apparatus embodied by this invention. Some alternatives and changes have been suggested. It is intended within the spirit of this invention to include all such changes and modifications as would be apparent to those knowledgeable in this art, and which fall within the scope of the claims below.

I claim:

1. A compacting apparatus operable by a low pressure source of water comprising:

an elongated compression chamber having an inlet feed means including an opening for introducing material to be compacted in said chamber, and a closable opening spaced along said chamber from said inlet feed opening for permitting removal of a slug of compacted material;

a closed hollow press member closely received and slidably supported in said compression chamber for axial movement therealong between an advanced compacting position and a retracted position for permitting introduction of the material into the chamber via said feed means, said press member having one end thereof operable as a ram for compacting said material, said one end having a beveled flange extending in the axial direction about the periphery of said end to scrape said material from the sides of said chamber, and the other end thereof having a wall with two openings therein, said press member being arranged to close off said inlet feed opening as said press member is advanced to effect compaction of said material to thereby prevent escape of material being compacted;

a stationary piston disposed within said hollow press member, said piston including peripheral sealing means slidably engaging said press member at the interior thereof to divide the interior of said press member into two sections;

means for securing said piston against axial movement relative to said compression chamber, said securing means including a pair of tubular pipes extending through said openings in said other end of said press member, said openings in said other end of said press member having sealing means to seal against the pipes while allowing said axially directed motion of said press member within said compression chamber, said tubular pipes being fixedly secured to said piston at one end thereof and being fixed to said compression chamber at the other end thereof, said tubular pipes being adapted to be in fuid communication with a supply of water under relatively low pressure;

means including said pair of tubular pipes for defining a fluid circuit in flow communication with each of said sections of said press member at the interior thereof and being adapted for connection to a supply of water under pressure, and valve means in said fluid circuit means operable selectively to introduce water under pressure into one of the other of said sections for advancing and retracting the movable press member relative to said elongated compression chamber, wherein said press member is constructed such that one of said sections which is pressurizable by said water to cause advancement of said press member and compaction of material ahead of said press member has a cross-sectional area against which said pressurized water is effective in acting to develop compaction forces which is substantially equal to the cross-sectional area interiorly of the compression chamber.

* * * * *